United States Patent [19]

Drakesmith

[11] 3,980,534

[45] Sept. 14, 1976

[54] ELECTROCHEMICAL FLUORINATION AND AN ELECTRODE FOR USE THEREIN

[75] Inventor: Frederick Gerald Drakesmith, Bryn-Awelon, Mold, Wales

[73] Assignee: The Electricity Council, London, England

[22] Filed: Apr. 9, 1974

[21] Appl. No.: 459,448

[30] Foreign Application Priority Data

Apr. 11, 1973 United Kingdom ..... 17441/73

[52] U.S. Cl. ..... 204/59 F; 204/292

[51] Int. Cl.[2] ..... C25B 3/08; C25B 11/04

[58] Field of Search ..... 204/59 F

[56] References Cited

UNITED STATES PATENTS

| | | | |
|---|---|---|---|
| 2,713,593 | 7/1955 | Brice et al. | 204/59 F X |
| 3,255,099 | 6/1966 | Wolinski | 204/169 |
| 3,335,143 | 8/1967 | Erner | 204/59 F X |
| 3,616,336 | 10/1971 | Childs et al. | 204/59 F X |
| 3,692,643 | 9/1972 | Holland | 204/59 F |
| 3,699,156 | 10/1972 | Holland et al. | 260/486 H |
| 3,728,233 | 4/1973 | Ashe et al. | 204/59 F |
| 3,748,238 | 7/1973 | Heit et al. | 204/92 |

FOREIGN PATENTS OR APPLICATIONS

| | | | |
|---|---|---|---|
| 741,399 | 11/1955 | United Kingdom | 204/59 F |

OTHER PUBLICATIONS

Introduction to Organic Electrochemistry by Rifi et al., pp. 95, 98 and 99, pub. by Marcel Dekker, New York, 1974.

*Primary Examiner*—F.C. Edmundson

*Attorney, Agent, or Firm*—Beveridge, DeGrandi, Kline & Lunsford

[57] ABSTRACT

In a process for electrochemical fluorination of a substrate by the use of a cell comprising a cathode and a nickel anode immersed in hydrogen fluoride the anode potential is carefully controlled between fixed limits with respect to a reference electrode both during an initial conditioning phase (when the nickel anode acquires a layer of nickel fluoride) to give a reproducible electrode surface and during a subsequent reaction phase when the substrate for fluorination is added. The invention also provides an electrode which comprises two sheets of a nickel foam produced by plating nickel onto a polyurethane foam and subsequently destroying the organic matter, which sheets sandwich a nickel mesh feeder plate.

15 Claims, 1 Drawing Figure

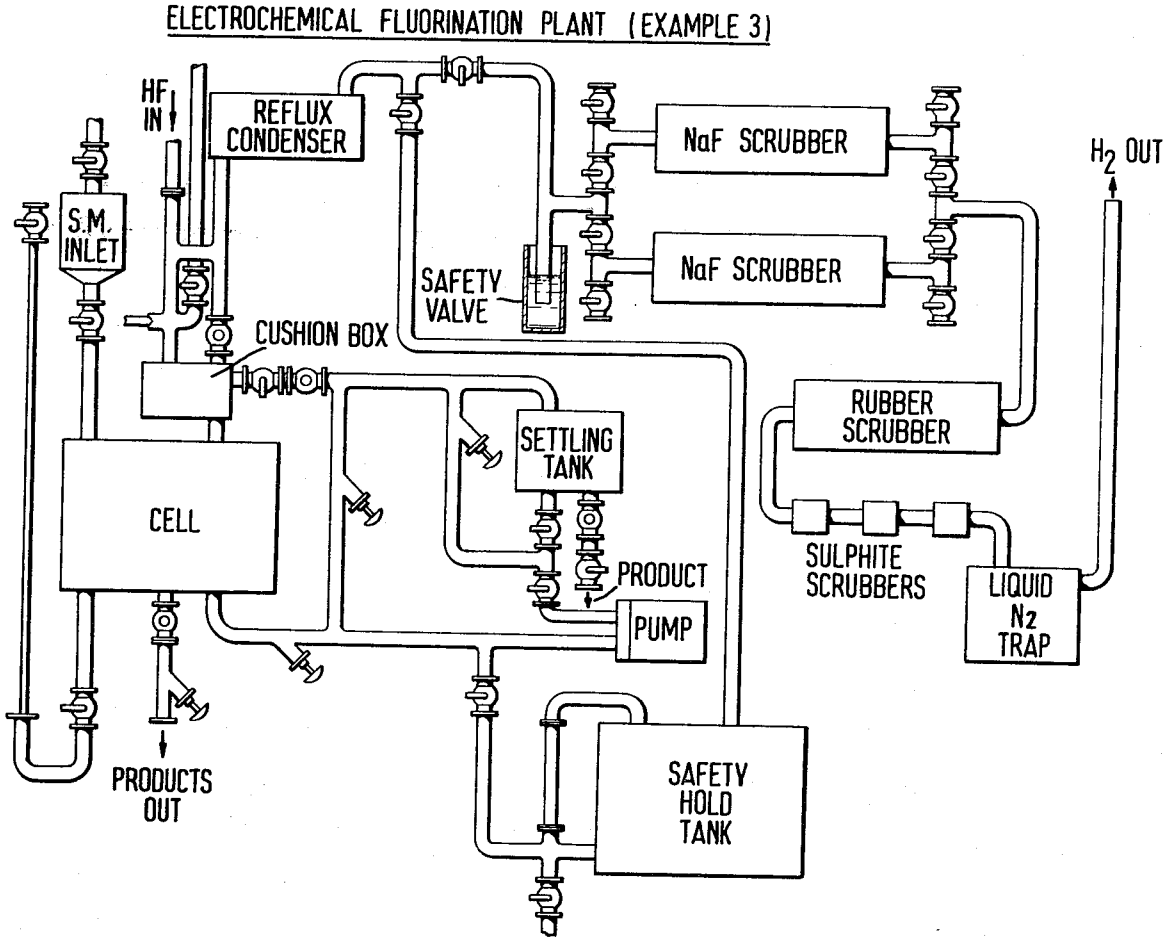
ELECTROCHEMICAL FLUORINATION PLANT (EXAMPLE 3)
$H_2$ OUT
LIQUID $N_2$ TRAP
RUBBER SCRUBBER
SULPHITE SCRUBBERS
NaF SCRUBBER
NaF SCRUBBER
SAFETY HOLD TANK
PRODUCT
PUMP
SETTLING TANK
SAFETY VALVE
CUSHION BOX
REFLUX CONDENSER
HF IN
S.M. INLET
CELL
PRODUCTS OUT

ELECTROCHEMICAL FLUORINATION AND AN ELECTRODE FOR USE THEREIN

BACKGROUND OF THE INVENTION

1. Field of the Invention

This invention relates to a process for electrochemical fluorination wherein strict anode potential control is maintained, and to a nickel foam electrode suitable for use in such a process.

Fluorinated compounds have many uses and applications. Thus, trifluoroacetic acid, the most readily available perfluorocarboxylic acid, is used as the starting point in the synthesis of many trifluoromethyl derivatives especially in the dyestuffs and pharmaceutical industries. The acid is also used, together with its anhydride, as a solvent in several esterification and condensation reactions. The introduction of fluorine into small molecules can also result in the production of precursors for polymeric materials.

Fluorocarbon derivatives, and in particular substances consisting of an aliphatic perfluorocarbon chain containing a conventional organic grouping (e.g. alcohol, carboxylic or sulphonic acid), are of special interest because of their dual nature. The chemical inertia, the hydrophobicity and organophobicity of perfluorinated parts of these molecules, in association with the very reactive groupings, give them unusual and very useful surface-active properties with respect to aqueous media, and liquid and solid organic media.

These characteristics have resulted in such compounds being used in various fields, e.g. textile finishes, leather treatment, paper finishes, firefighting, polishes, metal treatment (to produce a protective layer), and electroplating.

DESCRIPTION OF THE PRIOR ART

In simple terms electrochemical fluorination, a technique useful in preparing such compounds, relies upon the electrolysis of hydrogen fluoride in the presence of an added substrate, the fluorination of which substrate is desired. The precise mechanism of such fluorination processes is unknown.

An example of an electrochemical fluorination process is that described in British Pat. No. 1,262,270. In this process a mixture of hydrogen fluoride and feedstock (in this case a benzoyl compound having a single carbonyl group and which may also contain a single alkyl chain attached to the benzene ring) is prepared and direct current electrolysis of the mixture initiated. Electrolysis is continued during a prolonged period of initial low yield (an induction period), additional charge stock normally being supplied during this period. The electrolysis then proceeds to a post-induction period (longer than the induction period) when additional amounts of charge stock are added. Perfluoro compounds may be recovered from the electrolytic cell. British Pat. No. 1,262,270 specifically describes processes wherein direct current is initially applied to the cell to dry the hyrogen fluoride before feedstock addition. This current is applied and increased until the current drawn is below 5 amperes at an applied 7 volts indicating dry HF.

In general, when using nickel electrodes in electrochemical fluorination techniques the virgin anode when immersed in "wet" (0.2%$H_2O$) hydrogen fluoride (commercial "anhydrous hydrogen fluoride") first forms a surface layer of nickel oxide. As a result of the formation of this oxide layer there is an induction period in the use of such electrodes wherein the oxide layer is converted to a fluoride layer, at which point fluorination may be commenced when the cell has attained equilibrium.

SUMMARY

The present inventor has found that careful potentiostatic control over the anode potential during this induction period or "conditioning phase" results in a reproducible electrode surface from one experiment to another. With careful control, an increase in current density to a maximum equilibrium value occurs as a function of time. Continued passage of current during the conditioning phase converts the initial oxide layer through a complex series of nickel oxyfluorides to the final nickel fluoride layer.

The inventor has also found that since breakdown of organic compounds occurs to a much greater extent when the anode potential exceeds +6V careful monitoring or control of the anode potential during the actual "reaction phase" of electrochemical fluorination leads to better results.

Accordingly, the present invention provides a process for electrochemical fluorination of a substrate employing a cell comprising a cathode and a nickel anode immersed in hydrogen fluoride and a reference electrode, which process comprises passing a current through said cell during an initial conditioning phase of said process whereby said nickel anode acquires a layer of nickel fluoride which provide a reproducible electrode surface, adding at least a portion of said substrate to said cell, and passing a current through said cell during a reaction phase of said process whereby said substrate is fluorinated, said anode having a potential which is controlled between fixed values relative to said reference electrode during said initial conditioning and reaction phases.

The invention includes a nickel foam electrode comprising a sheet of a nickel foam which has been made by a process which comprises plating nickel onto a polyurethane foam and subsequently destroying said polyurethane foam.

DETAILED DESCRIPTION

The cell employed in the present process contains a third, reference electrode for assessing anode and, if desired, cathode potential. This electrode can, for example, be simply a nickel wire sheathed in P.T.F.E., or an autogenous hydrogen electrode. For the purpose of assessing anode potentials the reference electrode is taken to be at a potential of 0.0V.

Preferably the reference electrode used in the present process is a nickel wire sheathed with P.T.F.E. in such a way as to prevent any fluorine liberated during the conditioning phase coming into contact with the nickel wire. If properly shielded in this way, this type of electrode will maintain a half cell electrode potential of 0.0V (vs. $H_2$ electrode) sufficiently constant for the purposes of the present process.

Yet another type of reference electrode is that provided by an auxiliary electrode system. This method involves the use of the third electrode as both the reference in the main electrode system of the process, and as the cathode in an auxiliary electrode system with a fourth electrode as the anode, the current being supplied through the auxiliary system by means of a current limiting device. Thus, if the current in this auxiliary system is limited to a small value, say 10 ma, then a nickel wire as the reference/auxiliary cathode will maintain a potential of about 0.0V (vs. $H_2$ electrode), sufficiently constant for the purposes of the present process. This effect comes about as a result of the nature of the current/potential relationships of anodes and cathodes in anhydrous hydrogen fluoride.

The conditioning phase (which may, for example, last for one hour) can be carried out with an anode potential between +4.0V and +7.0V, preferably between +5.5V and 6.0V. Current is passed through the cell under these potentiostatic conditions until the current density ceases to increase with time.

After conditioning the anode potential is lowered to between +3.8V and +6.0V, preferably between +4.25V and +5.0V, and the system allowed to re-establish electrical equilibrium before addition thereto of organic starting material.

Anode potential control may be achieved by the use of a potentiostat (Chemical Electronics Ltd) with larger scale plant the power is supplied by a transformer/rectifier system, the electrode potential being metered and compared with a reference electrode. The electrode potentials will then be controlled, not electronically as with the potentiostat, but by altering other parameters of the system.

During the reaction phase of the electrochemical fluorination procedure the concentration of starting material is a most important factor. If the concentration is too high polymerization may result; if the concentration is too low yields of fluorinated products will be poor. Furthermore, the conductivity of the electrolyte, and therefore the current/voltage relationship, is a function of the number and type of ions present. The efficiency of separation of fluorinated products is also a function of the composition of the electrolyte. Thus, it is preferable to maintain a constant starting material concentration by addition to the system of starting material as the reaction occurs, so that the process of this invention preferably is a continuous rather than a batch process.

The process for electrochemical fluorination of this invention is applicable to practically any organic compound. However, it has a decided advantage over other methods of fluorination (e.g. direct elemental fluorination or the use of high valence metal fluorides) in that it permits the fluorination of certain hydrocarbon compounds containing functional groups to give the perfluoro analogues with retention of the functional group. Thus, its main application is in the preparation of such compounds as perfluoro-ethers, -carboxylic acids, and -sulphonic acids.

The present invention also includes a nickel foam electrode, suitable for use in the above process, formed by using polyurethane foam. Polyurethane foam provides a substrate onto which nickel is plated. The organic material is subsequently destroyed leaving a nickel foam structure.

A suitable electrode structure is provided by two of said sheets of nickel foam sandwiching a nickel mesh plate. A plurality of such structures can be used to provide an electrode package or block.

Foam electrodes provide a very much greater surface area per unit cell volume (e.g. 80 mesh foam (i.e. 80 holes/in.) has an area/volume ratio of 1700:1) than plate, or other two dimensional electrodes. This allows a higher current/unit volume of cell ratio resulting in lower capital costs, or, alternatively, the use of lower current densities resulting in less breakdown of organic materials. The current choice of foam mesh size allows free circulation of the electrolyte, either by stirring or by pumping through an external circuit, throughout the cell, which may be tightly packed with foam electrodes. The limits of mesh size are governed on the minimum side by possible restriction or blockage of the flow of the electrolyte, and on the maximum side by lowering of the surface area/volume ratio of the foam to a point where yields are low.

The invention therefore includes a process for electrochemical fluorination of the type set out above wherein at least one electrode is a nickel foam electrode. Such an electrode may, for example, be formed by using polyurethane foam.

When the substance which is being fluorinated is a gas under the conditions of operation adequate distribution of the gaseous substance around the anode is simply achieved by bubbling the gas, into the cell. The foam structure of the electrodes ensures that sufficient mixing of reactants occurs. With a substance which is liquid under the conditions of operation adequate mixing of reactants is more difficult to achieve and preferably involves specially designed pumping and circulating systems (possibly the use of an external circuit) and careful relation of electrode foam mesh size to avoid blockages due to too fine a degree of porosity. Flow of materials through the electrodes is thus carefully maintained. Fluorination albeit with lower yields, can, of course, be achieved without special mixing and circulating systems in the process of the present invention, but the use of such system is preferred.

The invention will now be illustrated by way of the following three specific Examples.

Example 1 is concerned with the fluorination of a gas (propene), and Example 2 with fluorination of a liquid (octanoyl chloride).

In Example 3 a larger scale plant is used and the sandwich-structure electrode package or block described above is also used.

The commercial "anhydrous hydrogen fluoride" used in these Examples has a nominal water content of 0.2%. During transfer from cylinder to reaction cell the hydrogen fluoride probably picks up more water from the atmosphere. During the conditioning phase of the reaction it is this water that is responsible for the formation of nickel oxides and oxyfluorides. The electrolysis process in this phase renders the electrolyte anhydrous.

EXAMPLE 1

THE ELECTROCHEMICAL FLUORINATION OF PROPENE

Apparatus

The cell (capacity 170 ml) had an all P.T.F.E. cylindrical body in three sections, sealed with Viton gaskets.

The base section was fitted with a gas inlet pipe and nickel electrical contact with the anode. The cell head section possessed an HF filler pipe, a reference electrode contact, a cathode contact, and a gas outlet connected via a nickel reflux condenser (−20°) to a scrubber system. The scrubber system consisted of a brass tube packed with solid KF (to remove entrained HF as $KHF_2$), an aqueous KOH solution (to remove any remaining HF), a series of three aqueous saturated sodium sulphite solutions, and finally, a liquid nitrogen cooled trap for the collection of products.

The circular (dia. 5.5 cm) anode was nickel foam (80 mesh, 1 cm thick) situated between the bottom and middle sections of the cell. Electrical contact to the foam anode was made by compression against a sheet nickel annulus connected to Ni wire through the base of the cell.

The cathode was nickel foam through which large holes were punched to facilitate the passage of gas through the cell. Electrical contact to the foam cathode was made by compression against a sheet nickel annulus connected to nickel wire through the head of the cell. The reference electrode was a nickel wire sheathed in P.T.F.E. except at the tip, which was in close proximity to the surface of the anode.

Procedure

The cell, cooled to −7° by immersion in a thermostatically controlled bath, was filled with anhydrous hydrogen fluoride. Nitrogen (8 ml/min) was passed through the cell. The anode was conditioned by potentiostatically controlling its potential at +6.0V (vs. the reference electrode) for 40 minutes, during which time the current had risen to, and was constant at, 1.75*a*, with a total cell voltage of 7.7V. The anode potential was then lowered to 4.80V (vs. ref. electrode) and the cell allowed to reach equilibrium (I = 1.4a,T.P.D. = 6.12 Volt). Propene (5.7 ml/min, 0.64 g/hr) was mixed with the nitrogen (8 ml/min) and passed through the cell for 18 hrs. with these electrical parameters, during which time the product was trapped (10.5g).

The product was transferred to a vacuum system and allowed to expand to atmospheric pressure at room temperature. The gaseous products were analysed using the usual vapour phase chromatographic, infra red-, nuclear magnetic-, and mass-spectroscopic techniques and shown to consist of:

$CF_4$(2.0%), $C_2F_6$(2.7%), $C_3F_8$(37.7%), $C_3H_8$(8.9%), $C_3HF_7$(10.1%), $C_3H_2F_6$(8.7%), $C_3F_2H_6$(5.3%) and $C_4H_{10}$(24.5%).

The total current passed during fluorination of the organic compound was 90,600 coulombs. This represents a current efficiency calculated for the introduction of fluorine into propane of 94%.

EXAMPLE 2

ELECTROCHEMICAL FLUORINATION OF OCTANOYL CHLORIDE

Apparatus

The cell (capacity 1 liter) was a nickel cylinder (I.D. 5.8 cm) surrounded by a cooling jacket. The P.T.F.E. base was fitted with two drain taps, and the P.T.F.E. head fitted with an HF filler pipe, a reference electrode contact, anode and cathode contacts, and an outlet pipe connected to the reflux condenser and scrubber system previously described.

The electrode package consisted of alternate anodes and cathodes made of nickel foam (80 mesh, 1cm, thick) separated by P.T.F.E. spacers (0.3 cm. thick). Electrical contact with the foam was made by compression to a nickel strip. The reference electrode was a nickel wire sheathed in P.T.F.E. except at the tip, and inserted down a hole drilled through the electrode package, which completely filled the cell.

Procedure

The cell, cooled to +5° by circulation of thermostatically controlled coolant through jacket, was filled with A.H.F. and the anodes conditioned by potentiostatically controlling its potential at +5.50V(vs. refer. electrode) for 1 hr, during which time the current had risen to, and was constant at, 15*a*, with a total cell voltage of 7.15V. The anode potential was then lowered to +4.3V and the current stabilised at 6*a*. Octanoyl chloride (300 g) dissolved in HF (200 ml) drained from the cell, was added to the cell and the mixture electrolysed with a constant anode potential of +4.3V until no more product was drained from the taps of the base of the cell. At the end of this period (8 days) the total product drained from cell was 268.8g, and the product in the liquid nitrogen trap was 59.5g. When the cell was opened it was found to contain a brown hydrofluoropolymer (250g). Analysis of the products by the usual techniques of vapour phase chromatography, infra-red-, nuclear magnetic-and mass-spectroscopy, as well as acid-base titration showed these to be (*a*) from the drain taps, a mixture of $C_7F_{15}COF$,

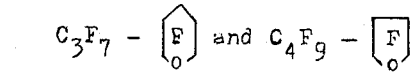

and (*b*) from the liquid nitrogen trap, mainly $C_7F_{16}$ with a small amount of fluorinated breakdown products. The yield of $C_7F_{15}COF$ based on $C_7H_{15}COCl$ added was approximately 12%.

EXAMPLE 3

ELECTROCHEMICAL FLUORINATION OF OCTANOYL CHLORIDE

Apparatus

The scaled-up plant used in this Example is illustrated diagrammatically in the attached figure.

The cell was a rectangular nickel box (43 × 30.5 × 56 cm) surrounded by a mild steel cooling jacket. The polythene base of the cell was fitted with three drain taps, one connected to a level indicator, another connected to the external pumping circuit. The polythene cell head was fitted with a filler port and an exit port. Nickel stubs through the head allowed sealed electrical connections to the electrodes in the cell. The exit port was connected to the external pumping circuit and the gas scrubbing system via a cushion box between the cell and the nickel HF reflux condenser. The effluent from condenser was passed through heated sodium fluoride packed scrubbers, heated rubber packed scrubbers, and aqueous sodium sulphate scrubbers, then through a liquid nitrogen cooled trap.

The electrode package consisted of alternate anode packs and nickel mesh (36 cm × 25 cm 22 gauge expanded). Each of the three anode packs consisted of 2 nickel foam sheets (45 mesh, 36.6 cm × 25.4 cm × 1 cm) sandwiching a nickel mesh feeder plate. The cell was fitted with an auxiliary reference electrode circuit, a conductivity cell and internal thermocouple temperature probes.

Procedure

The cell, cooled to 0°C by circulation of thermostatically controlled coolant through the jacket, was filled with hydrogen fluoride. The external pumping circuit was not filled for static runs. The hydrogen fluoride was dried by passing a current of 1.8 amps for approximately 96 hours.

Conditioning of the anodes was performed in the usual way, by holding the anode potential at 5.5V (vs. reference electrode) for up to 6 hours.

Octanoyl chloride dissolved in hydrogen fluoride was then added to the cell and electrolysis continued until no further product was drained from the base of the cell, while the anode potential was maintained at 4.3 ± 0.2V (vs. ref. electrode).

A typical reaction would involve the electrolysis of 4 kg of octanoyl chloride at 6.0V T.P.D. and 25 amps for 60 days to give yields of perfluoro-octanoyl fluoride and perfluoro-cyclic ethers of 60–70%.

While three specific embodiments of the invention have been described in detail above, it is to be understood that various modifications may be made from the specific details described without departing from the spirit and scope of the invention.

I claim:

1. A process for electrochemical fluorination of a substrate employing a cell comprising a cathode and a nickel anode, said nickel anode being selected from the group consisting of nickel mesh and nickel foam, immersed in hydrogen fluoride electrolyte and a reference electrode, which process comprises initially conditioning said nickel anode prior to introduction of a substrate to be fluorinated into the electrolyte, said conditioning being conducted by passing a current through said hydrogen fluoride electrolyte between a cathode and said nickel anode at least until the current density ceases to increase with time to provide said nickel anode with a layer of nickel fluoride which provides a reproducible electrode surface, placing at least a portion of said substrate in the electrolyte, and fluorinating said substrate by passing a current through the electrolyte during a reaction phase of said process, and controlling between fixed values the potential difference between said anode and said reference electrode during said initial conditioning and fluorinating steps.

2. A process according to claim 1, wherein said reference electrode is a nickel wire sheathed in P.T.F.E.

3. A process according to claim 1, wherein said reference electrode is an autogenous hydrogen electrode.

4. A process according to claim 1, performed with a fourth electrode which together with the reference electrode forms an auxiliary electrode system, said reference electrode serving as an auxiliary cathode and said fourth electrode serving as an auxiliary anode, and supplying current through said auxiliary electrode system by a current limiting device.

5. A process according to claim 1, wherein said potential difference during said initial conditioning step is between about 4.0V and 7.0V.

6. A process according to claim 1, wherein said potential difference during said substrate fluorinating step is between about 3.8V and 6.0V.

7. A process according to claim 1, wherein said potential difference is controlled by the use of a potentiostat.

8. A process according to claim 1, including the step of supplying by a transformer rectifier system said current for said initial conditioning step and said substrate fluorination step, and metering and comparing said anode potential with a reference electrode.

9. A process according to claim 1, wherein said substrate is present in said cell during said substrate fluorination step in a substantially constant concentration as a result of addition of said substrate throughout said reaction phase.

10. A process according to claim 1, wherein said substrate placed in the electrolyte is a hydrocarbon compound containing a functional group.

11. A process according to claim 1 wherein said anode is nickel foam formed on a polyurethane foam, said polyurethane foam having subsequently been destroyed.

12. A process according to claim 1, wherein said cathode comprises a nickel foam.

13. A process according to claim 12, wherein said cathode of nickel foam is formed by plating nickel onto a polyurethane foam and subsequently destroying said polyurethane foam.

14. A process according to claim 1, wherein said substrate is a gas, said gas being bubbled into said cell during said substrate fluorination step.

15. A process for electrochemical fluorination of a substrate employing a cell comprising a cathode a nickel anode immersed in hydrogen fluoride and a reference electrode which is provided by an auxiliary electrode system, said auxiliary electrode system comprising a cathode which serves as said reference electrode and an anode, comprising the steps of supplying current through said auxiliary system by means of a current limiting device, passing a current through said cell during an initial conditioning phase prior to the introduction of a substrate to be fluorinated into the hydrogen fluoride, said initial conditioning phase being conducted until the current density ceases to increase with time whereby said nickel anode acquires a layer of nickel fluoride which provides a reproducible electrode surface, adding said substrate to said cell, and passing a current through said cell during a reaction phase of said process wherein said substrate is present in said cell in a substantially constant concentration as a result of addition of said substrate throughout said reaction phase to fluorinate said substrate, maintaining said anode at a potential with respect to said reference electrode, said potential being maintained between +5.5V and +6.0V during said initial conditioning phase and being maintained between +4.25V and +5.0V during said reaction phase, said anode comprising two sheets of a nickel foam sandwiching a nickel mesh plate and being formed by plating nickel onto a polyurethane foam and subsequently destroying said polyurethane foam.

* * * * *